US009506482B2

(12) United States Patent
Valentin-Rumpel

(10) Patent No.: US 9,506,482 B2
(45) Date of Patent: Nov. 29, 2016

(54) ELECTROPNEUMATIC CONTROL DEVICE AND ELECTROPNEUMATIC SUBASSEMBLY

(71) Applicant: Frank Valentin-Rumpel, Gross-Umstadt (DE)

(72) Inventor: Frank Valentin-Rumpel, Gross-Umstadt (DE)

(73) Assignee: SAMSON AKTIENGESELLSCHAFT, Frankfurt (DE)

( * ) Notice: Subject to any disclaimer, the term of this patent is extended or adjusted under 35 U.S.C. 154(b) by 494 days.

(21) Appl. No.: 14/063,303

(22) Filed: Oct. 25, 2013

(65) Prior Publication Data

US 2014/0116241 A1 May 1, 2014

(30) Foreign Application Priority Data

Oct. 31, 2012 (DE) ..... 10 2012 021 387

(51) Int. Cl.

| | |
|---|---|
| ***F15B 21/08*** | (2006.01) |
| ***F15B 5/00*** | (2006.01) |
| ***F15B 13/043*** | (2006.01) |
| ***F15B 15/20*** | (2006.01) |

(52) U.S. Cl.

CPC ..... *F15B 21/08* (2013.01); *F15B 5/006* (2013.01); *F15B 13/043* (2013.01); *F15B 15/202* (2013.01); *F15B 2211/30565* (2013.01); *F15B 2211/6336* (2013.01); *F15B 2211/6653* (2013.01); *F15B 2211/6656* (2013.01)

(58) Field of Classification Search

CPC ..... F15B 13/0857; F15B 5/006; F15B 5/08; F15B 2211/6336; F15B 13/0803; F15B 2013/002

See application file for complete search history.

(56) References Cited

U.S. PATENT DOCUMENTS

| | | | | |
|---|---|---|---|---|
| 7,938,145 | B2 * | 5/2011 | Phillips | F15B 13/0814 137/884 |
| 8,375,842 | B2 * | 2/2013 | Kolbenschlag | F15B 11/08 91/361 |
| 2006/0016183 | A1 | 1/2006 | Hoffmann | |
| 2009/0199703 | A1 * | 8/2009 | Hoffmann | F15B 11/028 91/361 |
| 2009/0307405 | A1 | 12/2009 | Ottliczky | |
| 2012/0054483 | A1 | 3/2012 | Haaf | |
| 2012/0179423 | A1 | 7/2012 | Robl | |

FOREIGN PATENT DOCUMENTS

| | | |
|---|---|---|
| DE | 4227201 | 2/1994 |
| DE | 196 42 181 A1 | 4/1997 |
| DE | 196 36 418 A1 | 3/1998 |

(Continued)

*Primary Examiner* — Thomas E Lazo
*Assistant Examiner* — Abiy Teka
(74) *Attorney, Agent, or Firm* — Schiff Hardin LLP

(57) ABSTRACT

In a electropneumatic field device, an electrical field input and a pneumatic supply input are provided. At least one field output is provided at which a field output signal is output based on a field control signal received via the electrical field input. A group comprising at least two modular components of different functionality is provided and at least one modular slot for occupation with either of said modular components from said group. The at least two modular components of the group and the at least one slot are modularly adapted to one another such that interfaces of the slot and interfaces of either of said modular components in the seat merge into one another when the slot is occupied with either of said modular components so that the modular component which is in the slot is connected to the electrical field input and to the at least one field output.

12 Claims, 6 Drawing Sheets

(56) References Cited

FOREIGN PATENT DOCUMENTS

| | | | |
|---|---|---|---|
| DE | 203 07 308 | U1 | 7/2003 |
| DE | 102004035047 | | 2/2006 |
| DE | 20 2006 00 916 | U1 | 3/2006 |
| DE | 10 2004 043 062 | B3 | 4/2006 |
| DE | 102008053844 | | 5/2010 |
| DE | 10 2009 029 495 | A1 | 3/2011 |
| DE | 10 2010 035 102 | A1 | 4/2012 |
| EP | 0 587 170 | A2 | 3/1994 |
| EP | 1 081 389 | A2 | 3/2001 |
| EP | 1138994 | | 10/2001 |
| EP | 2 047 340 | A1 | 4/2009 |
| EP | 2 204 586 | A1 | 7/2010 |

* cited by examiner 1
3
5
7
11
13
15
17
18
19
21
23a
23b
23c
23d
25a
25b
25c
25d
27
31
33
33a
33b
33c
33d
35a
35b
35c
35d
37a
37b
37c
37d
41
A1
A2
A3
A4
S1
S2
S3
S4
I1
I2
I3
I4
O1
O2
O3
O4
X
W
Pz 7
A4
A3
A2
A1
57
25d
35d
23d
33d
S3
S2
S1
p
e
23c
55c
23b
55b
23a
55a
61
63
3
5
15
17
18
21
31
W
X
Pz
I1 I2 I3 I4
O1 O2 O3 O4

7
A4
A3
A2
A1
S3
S2
S1
M
p
e
23d
23c
23b
23a
25d
55c
55b
25a
65
67
31
Pz
17
W
X
21
I1 I2 I3 I4
O1 O2 O3 O4
3
5

ELECTROPNEUMATIC CONTROL DEVICE AND ELECTROPNEUMATIC SUBASSEMBLY

BACKGROUND

The disclosure relates to an electropneumatic field device, such as an electropneumatic position controller, an I/P transducer, or the like. The electropneumatic field device is often used as a control device for controlling a pneumatic actuator of a processing plant, for example in the petrochemical industry, the food industry or the like, which in turn actuates a control valve for regulating a process fluid flow.

The electropneumatic field device has at least one electrical field input, via which the field device receives an electrical field input signal, which for example in the case of a pneumatically operated control valve can be formed as a set-point control signal. The field input signal can for example be an analog 4-20 mA current signal or else a digital field bus signal, such as Profibus PA, Foundation Fieldbus, ASI or Devicenet. Furthermore, the electropneumatic field device has at least one electronic and/or pneumatic component, which is for example an electropneumatic transducer, a data memory, a pneumatic current generator and/or a microprocessor. It shall be clear that the electropneumatic field device can have a plurality of electronic and/or pneumatic components, such as a plurality of electropneumatic transducers, microprocessors, electrical switches, data memories and/or pneumatic current generators. The at least one electronic and/or pneumatic component is connected to the at least one electrical field input, in order to obtain the electrical field input signal. It is known, particularly if a position controller is used as the field device, that an open loop and/or closed loop control electronics can be interconnected between the electrical field input and the electronic and/or pneumatic component. In case of an electropneumatic transducer as the at least one electronic and/or pneumatic component, the electropneumatic transducer is pneumatically coupled to the pneumatic supply input of the field device. The field device usually has a pneumatic field output, at which a pneumatic field output signal for example for controlling the pneumatic actuator can be output on the basis of the field input signal received.

An electropneumatic field device is known from DE 10 2008 053 844 A1, in which a plurality of electronic and/or pneumatic components, such as an electronic regulator, a U/I transducer, an I/P transducer, a power amplifier, and also an inverting amplifier can be used. An inverting amplifier is used when the electropneumatic field device accesses a double-action pneumatic actuator.

A position controller for controlling and/or regulating a pneumatic actuator is known from EP 1 138 994 A2. The position controller has a main housing and a removable maintenance cassette, the interior of which is divided into a partition for electropneumatic assembly elements and an electronics partition. The entire maintenance cassette can be removed from the main housing for maintenance purposes.

SUMMARY

It is an object to improve the known electropneumatic field device such that an economic expense for the operator of a processing plant in terms of functional set up and design of the electropneumatic field device is reduced considerably.

In a electropneumatic field device, an electrical field input and a pneumatic supply input are provided. At least one field output is provided at which a field output signal is output based on a field control signal received via the electrical field input. A group comprising at least two modular components of different functionality is provided and at least one modular slot for occupation with either of said modular components from said group. The at least two modular components of the group and the at least one slot are modularly adapted to one another such that interfaces of the slot and interfaces of either of said modular components in the slot merge into one another when the slot is occupied with either of said modular components so that the modular component which is in the slot is connected to the electrical field input and to the at least one field output.

DESCRIPTION OF EXEMPLARY EMBODIMENTS

Figure 1:
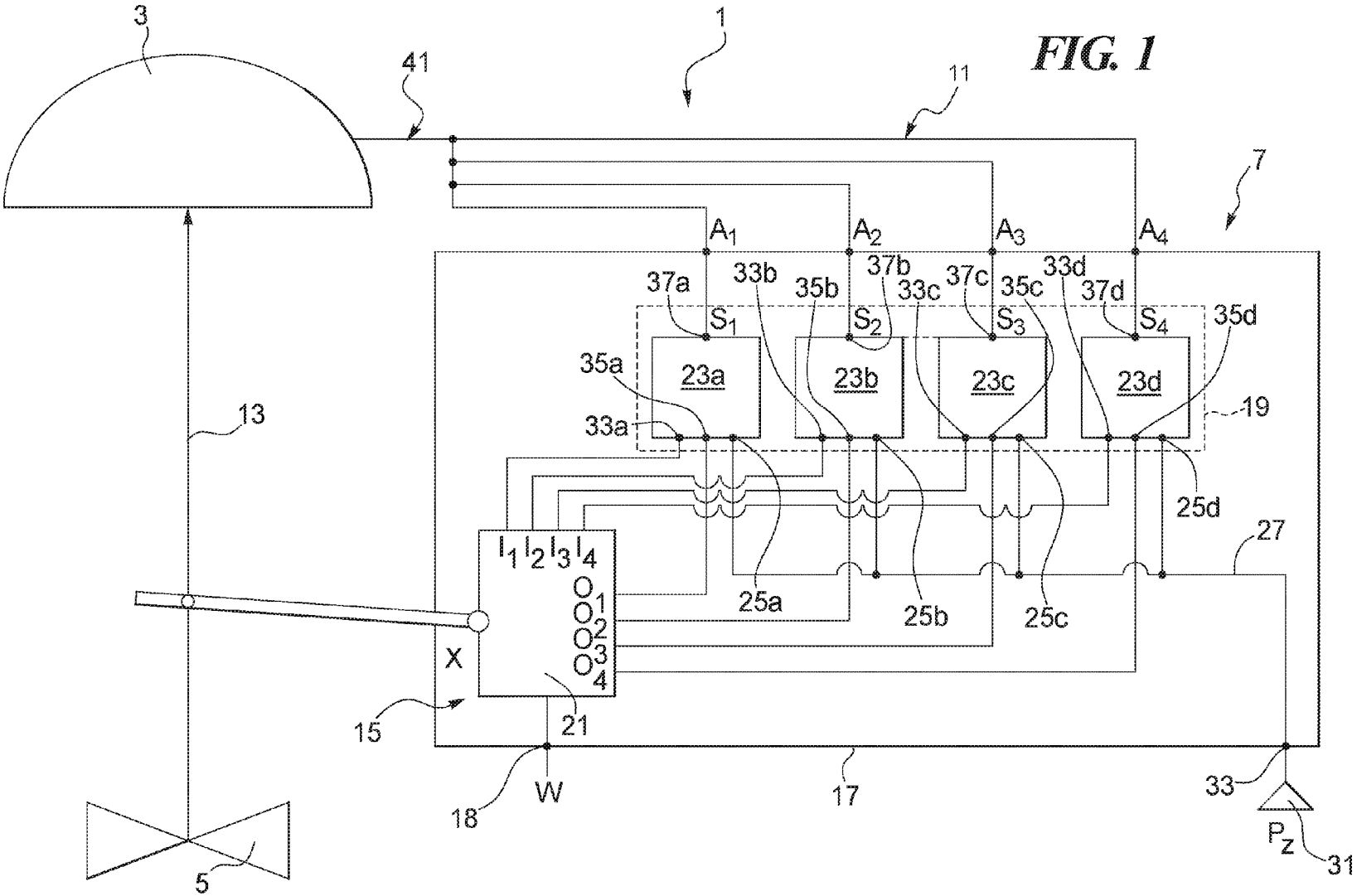
FIG. 1 shows a schematic illustration of an electropneumatic field device according to one preferred exemplary embodiment.

For the purposes of promoting an understanding of the principles of the invention, reference will now be made to preferred exemplary embodiments/best mode illustrated in the drawings and specific language will be used to describe the same. It will nevertheless be understood that no limitation of the scope of the invention is thereby intended, and such alterations and further modifications in the illustrated embodiments and such further applications of the principles of the invention as illustrated as would normally occur to one skilled in the art to which the invention relates are included herein.

An electropneumatic field device according to one exemplary embodiment, such as an electropneumatic position controller, an I/P transducer or the like, has at least one electrical field input, a pneumatic supply input, at least one electronic and/or pneumatic component, such as an electropneumatic transducer, preferably a plurality of electropneumatic transducers, a microprocessor, a data memory, a pneumatic current generator and/or the like. The at least one electronic and/or pneumatic component is connected to the at least one electrical field input and also if appropriate to the pneumatic supply input. In addition, the pneumatic field device has a field output, at which a field output signal can be output on the basis of a field signal, particularly an open loop and/or closed loop control signal, received via the at least one electrical field input. According to the exemplary embodiment, the electropneumatic field device has a group comprising of at least two modular electronic and/or pneumatic components of different functionality and at least one modular slot for occupation with an electronic and/or pneumatic component in each case. The at least two electronic and/or pneumatic components of the group and the at least one slot are modularly adapted to one another in such a manner that the electrical and if appropriate pneumatic interface thereof merge into one another in a functionally and operationally reliable manner in each case when the slot is occupied. In the occupied position in the slot, the interfaces of the inserted electronic and/or pneumatic component and also the interface of the slot are located diametrically opposite one another, so that electrical contact and if appropriate a pneumatic, pressure-lossless coupling is realized. The electropneumatic field device according to the one exemplary embodiment can also have electronic and/or pneumatic components which are not arranged in a modular slot. A modular slot is used for accommodating a singular modular electronic and/or pneumatic component. The modular slot should be simple to access from an outside of the field device. Those electronic and/or pneumatic components of the group, which are not inserted, can be stored on the outer side of the housing at respective storage places of complementary shape to the modular slot, particularly electrically dead storage places, for later use in a modular slot.

The field output of the electropneumatic field device according an exemplary embodiment can be realized both pneumatically and electrically and is preferably formed by one of the electronic and/or pneumatic components in the modular slot. In the case of an electrical field output, an electropneumatic transducer can be provided externally, that is to say outside of the field device housing, which generates a pneumatic signal on the basis of the electrical field output signal for output for example to the pneumatic actuator.

The modular slot is designed to accommodate one singular modular electronic and/or pneumatic component from the group of electronic and/or pneumatic components of different functionality, such as one or a plurality of electropneumatic transducers, one or a plurality of microprocessors, one or a plurality of data memories, one or a plurality of pneumatic current generators and/or the like, in an exchangeable manner, while producing an electrical connection at the respective electrical interfaces and if appropriate while producing a pneumatic connection between the respective pneumatic interfaces. As the at least two electronic and/or pneumatic components are provided exchangeably at the electropneumatic field device according to an exemplary embodiment, the at least one slot is realized to be simple to access from outside (with respect to the field device housing). In this manner, the electropneumatic field device according to an exemplary embodiment has a high degree of modularity, which a plant operator or else plant builder can use in order to adapt to changing process conditions of the plant without large installation expense. Known actuators suffer from the disadvantage that the air power of the field device is unchangeably fixed, particularly limited, owing to permanently implemented I/P transducers. By means of the measure according to the exemplary embodiment of creating a modularity, particularly with regards to all electronic and/or pneumatic components, such as the electropneumatic transducer, the data memory, the pneumatic current generator, the microprocessor and/or the like, it is possible, for example to increase or reduce the air power of the field device considerably, but also to change the control routine by exchanging the control microprocessor, to provide an autonomous current generation and/or to change the same by exchanging the pneumatic current generator, implementing data for playback and storage at will by exchanging data memories, without having to manipulate the field device and/or the environment thereof. In this respect, the plant builder does not require a high temporal and constructive expense with the electropneumatic field device according to the exemplary embodiment, not to mention the necessity of interrupting the operation of the processing plant if they desire a change of operation of the electropneumatic field device to one or a plurality of functionalities. As regards the exchangeability of the electropneumatic transducer, the electropneumatic field device according to the exemplary embodiment has the advantage of not necessarily having to insert a separate volume booster into the pneumatic line system, should the air line of the installed electropneumatic transducer no longer be sufficient.

Preferably, it is conceivable that the electropneumatic field device according to the exemplary embodiment has at least two modular slots which are both occupied with a different electropneumatic transducer. Control electronics, which are for example permanently and unexchangeably installed within a housing of the electropneumatic field device or else can be exchanged in the way of the modular slot with different control electronics, select one of the two pressure transducers depending on the operating conditions, in order to be able to use the best suited pressure transducer parameters for the functional operation of the electropneumatic field device. In the interim period, the unselected electropneumatic transducer remains in the slot in a passive waiting position. Should a third electropneumatic functionality be used for example in the case of a two- or multiple-slot field device, there is the possibility of exchanging one of the electropneumatic transducers occupying the slot with a third electropneumatic transducer with the desired function, which electropneumatic transducer was for example stored at a dead storage place on the outer side of the field device housing.

All of the electronic and/or pneumatic components of the group, which are available for use at the at least one modular slot, are for example modularly adapted with respect to the slot such that the slot has a female recess shape which is at least partially complementary in shape to the male external profile of the respective electronic and/or pneumatic component. The mutually adapted shapes are chosen in such a manner that only one plug-in position is permitted, in order to ensure the adaptation of the electrical interface and if appropriate the pneumatic interface.

In one preferred embodiment, the at least one slot has a docking mechanism, which comprises a positive connection and/or traction-connection unit, such as a latching unit, particularly a manually actuatable clamp or a screw connection for releasable fastening of the respective electronic and/or pneumatic component in the modular slot. The positive connection and/or traction-connection unit can preferably be designed to impart a prestress of the respective electronic and/or pneumatic component so that the respective electrical interfaces and if appropriate the pneumatic interfaces of the slot and the electronic and/or pneumatic component are pressed against one another, in order to produce the electrical contact and also if appropriate the pneumatic connection.

In one preferred embodiment, the at least one slot is realized by a depression or recess, particularly in a housing wall of the field device. The electronic component can be accommodated in the depression in a positive-fitting manner.

In a development of the exemplary embodiment, the electropneumatic field device has a plurality of modular slots. The plurality of modular slots can either be occupied by identical electronic and/or pneumatic components, particularly of different functionality, or different electronic and/or pneumatic components. The occupation depends on the desired characteristic of the field device, for example the air power.

In one preferred exemplary embodiment, the at least one slot has an electrical interface connected to the electrical field input and if appropriate a pneumatic interface connected to the pneumatic supply input of the field device for pneumatically coupling a pneumatic connection of the electronic and/or pneumatic component, if for example an I/P transducer shall be used as electronic and/or pneumatic component.

Preferably, the at least one slot has a closure assigned to the pneumatic interface, which, in the occupied state of the at least one slot, closes the pneumatic interface thereof in an essentially airtight manner. In a state of the at least one slot in which it is occupied with an electropneumatic transducer, the closure is deactivated, so that a pneumatic connection of the pneumatic supply is established by the electropneumatic transducer.

In one preferred exemplary embodiment, each modular slot has an electrical interface connected to the at least one electrical field input and if appropriate, a pneumatic interface coupled with the pneumatic supply input. In the docked state of the respective electronic and/or pneumatic component, the respective interface is functionally connected to the electrical and if appropriate pneumatic connection thereof.

In a preferred exemplary embodiment, the at least one modular slot has one modular docking mechanism in each case for the at least one modular electronic and/or pneumatic component. The docking mechanism is designed to securely accommodate and hold the respective electronic and/or pneumatic component in the modular slot, particularly by means of latching, and also if appropriate to release, particularly in a destruction-free manner and preferably manually, particularly without a special tool, for an exchange of the electronic and/or pneumatic components.

In a development of the exemplary embodiment, the at least one modular slot has an identification apparatus in each case for detecting the type/the design of the electronic and/or pneumatic component. Preferably, the identification apparatus is designed, in the event of the occupation of the slot with an electronic and/or pneumatic component without pneumatic function, such as a microprocessor, to close a pneumatic interface of the slot in an essentially airtight manner or to activate an airtight closure. For this purpose, the identification apparatus can for example comprise an electrical and/or mechanical sensor, which is for example functionally coupled via an electronic unit, such as a particular permanently installed microprocessor, with a pneumatic closure arranged at the slot.

In a development of the exemplary embodiment, the field device has an electronic unit, such as a microprocessor, which can be inserted as a modular electronic and/or pneumatic component in the at least one modular slot. The electronic unit can however also be permanently installed within the field device housing as a permanently installed non-modular element. The electronic unit is designed to determine the occupation of the at least one modular slot with different electronic and/or pneumatic components and to correspondingly assign the field input signal received at the field device to the respective electronic and/or pneumatic component.

In a preferred exemplary embodiment, the electropneumatic field device has a housing which can be closed in particular in a fluid-tight manner. The housing can accommodate in particular permanently installed control or regulating electronics in a first section. In a preferred exemplary embodiment, the at least one modular slot is set up on an outer wall of a separating wall of a section or on an outer wall of the housing, so that an operator thereby has manual access to the at least one slot.

In a preferred exemplary embodiment, the arrangement can have a plurality of modular slots or else only one modular slot using a housing part which can be removed from the housing, such as a lid, particularly for forming a second housing part such that it can be closed in a preferably fluid-tight manner.

In a development of the embodiment, the at least one modular slot has an electrical connection diagram and, if appropriate, a pneumatic connection diagram. The at least one electronic and/or pneumatic component can have an electrical mating connection diagram and, if appropriate, a pneumatic mating connection diagram, wherein the mating connection diagram is realized to mirror the connection diagram, so that when simply inserting the electronic and/or pneumatic component into the slot, the electrical contact and also the pneumatic connection is produced directly.

In a preferred exemplary embodiment, the electropneumatic field device has at least one pair of modular slots, preferably three pairs of modular slots, wherein all of the slots are occupied with an electropneumatic transducer and in particular, one electropneumatic transducer of the slot pair is directly connected to a pneumatic working chamber of the control valve and the other electropneumatic transducer of the slot pair is pneumatically coupled with a pneumatic active element, such as a bleeder or a rapid bleeder, wherein the rapid bleeder is connected to the pneumatic working chamber in such a manner that, when receiving a particularly predetermined pneumatic output signal of the other electropneumatic transducer of the slot pair, the pneumatic working chamber of the actuator is aired or vented, preferably is coupled with an atmospheric pressure output of the pneumatic active element, wherein in the case of a double-action pneumatic actuator, the second working chamber is controlled by a second pair of correspondingly occupied slots.

In a preferred exemplary embodiment, the electropneumatic field device has a pair of modular slots, wherein the one slot is occupied with an electropneumatic transducer and the other slot is occupied with an electrical output stage, wherein the electropneumatic transducer is connected to an external pneumatic transducer, which in particular arranged outside of a housing of the field device, such as a solenoid valve, and which is connected to a working chamber of an actuator, wherein the electrical output stage is connected to the external electropneumatic transducer in such a manner that upon output of a predetermined electrical signal, the external electropneumatic transducer is aired, wherein in case of a double-action pneumatic actuator, a second pair of correspondingly occupied slots is provided for controlling the second working chamber.

In a preferred exemplary embodiment, the electropneumatic field device has a group made up of at least two modular electronic and/or pneumatic components, at least one electropneumatic transducer, at least one pneumatic current generator, at least one microprocessor, at least one electrical output stage, such as at least one switch and/or at least one data memory.

In a preferred exemplary embodiment, the housing structure for the electropneumatic field device is not realized by a common housing for all components, rather the housing of the electropneumatic field device is divided into at least two mutually separated housing parts. In a first housing part, in particular exclusively the electronic and/or pneumatic components are to be arranged in respective slots, wherein the slots should preferably be reachable from outside. In particular, only the slots for pneumatic components are provided in the second housing.

For example, the housing for the electronic and/or pneumatic components can be realized on a yoke or valve yoke connecting the actuator to the control valve housing, wherein the electronic and/or pneumatic components can for example be a microcomputer, a position sensor or the like. The second housing for the pneumatic electronic and/or pneumatic components is preferably attached on an outside wall of the actuator facing the control valve housing, wherein electronic pneumatic components, such as the I/P transducer or a booster can be arranged on the housing.

It shall be clear that the modular slots for the components of the electronic and/or pneumatic components should be realized such that they fit each electronic component or pneumatic component.

Furthermore, the exemplary embodiment relates to an electropneumatic subassembly with a control valve of a processing plant, a pneumatic actuator, particularly a double-action actuator or a single-action pneumatic actuator, for controlling a control valve, if appropriate a position sensor for detecting the position of the control valve and with an electropneumatic field device, as is described above.

Preferably, the position sensor is connected to the electropneumatic field device, particularly to the regulating electronics thereof, such as the microprocessor thereof, in a manner such that it transmits signals.

Further properties, features and advantages of the exemplary embodiments of invention become clear by way of the following description of preferred designs on the basis of the attached drawings.

In FIG. 1, a pneumatically operated control valve arrangement according to an exemplary embodiment, which is used for controlling or regulating a process fluid flow of a processing plant, which is not illustrated, such as a petrochemical plant, a food processing plant, such as a brewery, or the like, is generally provided with the reference numeral 1. This control valve arrangement 1 comprises as main constituents a pneumatic actuator 3, a control valve 5, which is actuated by the actuator 3 for regulating the process fluid flow of the processing plant which is not illustrated, and an electropneumatic field device 7 realized as position controller, which is connected via a pneumatic line system 11 to the pneumatic actuator 3.

The control valve 5 is mechanically connected to the pneumatic actuator 3 via a spindle or shaft 13. An in particular mechanically operating position sensor 15, which is arranged partially within a housing 17 of the electropneumatic field device 7, picks up the instantaneous position X of the control valve 5. The housing can have an internal space which can be closed in a fluid-tight manner, in which inter alia electrical lines, pneumatic connecting lines and/or a microprocessor are accommodated. It shall be clear that the housing 17 of the electropneumatic field device according to the exemplary embodiment can also be constructed just by a printed circuit board with pneumatic lines attached thereon.

The position sensor 15 emits a position signal to a microprocessor 21, which according to the illustration is accommodated in an internal space of the field device housing 17 and receives a set-point control signal w from a control center of the processing plant, which is not illustrated, via a field input 18 at the field device housing. In addition to the electrical field input 18, the electropneumatic field device 7 has a pneumatic field input 33 and four optionally usable pneumatic field outputs $A_{1\text{-}4}$.

The electropneumatic field device 7 or the position controller has four essentially identically structured plug-in slots or slide-in slots 23*a*, 23*b*, 23*c*, 23*d*, which are freely accessible from outside and can optionally be occupied with four individual electronic and/or pneumatic components of very wide ranging design. The electronic and/or pneumatic component may be an I/P transducer, a data memory, a pneumatically operated electric generator, the microprocessor 21 and/or an electronic switch, wherein electronic and/or pneumatic components of identical design, different functionality or performance parameters can be inserted in the slots. Each slot can only accommodate one singular electronic and/or pneumatic component however. The slots 23*a* to 23*d* are modularly adapted in such a manner that depending on which predetermined electronic component is inserted, they ensure the function of the electronic and/or pneumatic component by producing communication lines to the respectively other components.

The electropneumatic field device 7 can also have storage receptacles, which are not illustrated, for storing modular electronic and/or pneumatic components which are not inserted, which storage receptacles are essentially constructed to be identical in shape to the slots 23*a* to 23*d*, but do not have an electrical or pneumatic interface.

The electropneumatic field device 7 has a group made up of at least two electronic and/or pneumatic components, which can be selected to be inserted into the respective slots. The electronic and/or pneumatic components are not illustrated in any more detail in FIG. 1.

Each singular slot 23*a* to 23*d* of the field device has a pneumatic input interface 25*a* to 25*d*, which is connected via a supply line 27 running inside the housing 17 via the pneumatic field input 33 to a pneumatic supply source 31 of a constant 6 bar ($P_Z$) for example. The slots 23*a* to 23*d* additionally comprise an electrical output interface 33*a* to 33*d*, which is connected via electrical lines to one microprocessor input $I_{1\text{-}4}$ in each case. In addition, each slot 23*a* to 23*d* has an electrical input interface 35*a* to 35*d*, which is connected via electrical lines to a respective microprocessor output $O_{1\text{-}4}$. In this manner, the electronic and/or pneumatic components placed in the slots 23*a* to 23*d* can communicate with the microprocessor 21, so that for example a control or regulating signal can be output by the microprocessor 21 to the respective slot 23*a* to 23*d*. The microprocessor 21 determines or recognizes via the communication lines which design and type of electronic and/or pneumatic component is inserted at the respective slot 23*a* to 23*d* and/or whether the slot 23*a* to 23*d* is unoccupied.

Finally, each slot 23*a* to 23*d* has an output interface 37*a* to 37*d*, by means of which output signals either of an electrical nature (not illustrated in FIG. 1) or of a pneumatic nature $S_{1\text{-}4}$ can be output at the respective field device output $A_1$ to $A_4$. In the embodiment illustrated in FIG. 1, the field devices outputs $A_{1\text{-}4}$ are used pneumatically and can output a correspondingly pneumatic control signal $S_{1\text{-}4}$ via corresponding pneumatic lines 41 to the pneumatic actuator 3. As all pneumatic pressures of the individual I/P transducers inserted in the slot 23*a* to 23*d* have the same direction of action into the working volume of the pneumatic actuator, the air power increases considerably by means of the multiple decoupled control of the I/P transducers, as a result of which the control accuracy in the case of the position of the control valve is increased. If four I/P transducers of the same air power are used, the air power supplied to the pneumatic actuator is quadrupled.

Depending on which air power for example should be assigned to the electropneumatic field device 7, the slots 23*a* to 23*d* can also be occupied with four very different I/P transducers. If a slot 23*a* to 23*d* is occupied with an I/P transducer, then the microprocessor 21 detects the occupation via, for example, a suitable sensor system, which is not illustrated, and/or via the respective line connecting the electrical input interface 35*a* to 35*d* to the electrical microprocessor output $O_{1-4}$.

If a plurality of slots 23*a* to 23*d* should be occupied with different I/P transducers, then the microprocessor 21 can select only one of the same for operating the actuator 3. If for example, the microprocessor 21 selects the I/P transducer arranged in the slot 23*c* with a certain air power, then the microprocessor 21 outputs a corresponding electrical regulating signal via its output $I_3$ to the I/P transducer arranged in the slot 23*c*, which outputs a corresponding air pressure signal $S_3$ via the pneumatic output interface 37*c* to the pneumatic actuator 3, wherein the remaining I/P transducers in the slots 23*a*, 23*b*, 23*d* remain deactivated or at least unaddressed by the microprocessor 21.

If, for example, one of the slots 23*a* to 23*d* is not occupied, then the microprocessor 21 detects this. It then automatically induces the closure of the respective pneumatic input interface 55*a* to 55*d* of the unoccupied slot either itself by means of a corresponding control signal of the microprocessor 21 or by means of an independently operating closure apparatus (not illustrated). The same also applies if, instead of an I/P transducer, a pure electronic and/or pneumatic component, such as an electrical storage device occupies the respective slot 23*a* to 23*d*.

As already indicated, instead of the I/P transducer, other electronic and/or pneumatic components can be inserted in the slot 23*a* to 23*d*. For example, the slot 23*a* can be occupied with the microprocessor 21 which can communicate with the respective other slots. In addition, the slot 23*b* can be occupied by an I/P transducer, as described above, while the slot 23*c* is used by a pneumatic current generator for the electrical supply of the other electronic and/or pneumatic component. The slot 23*d* can be occupied by an electrical data memory or an electrical circuit which can be connected to an external electrical component.

Figure 2:
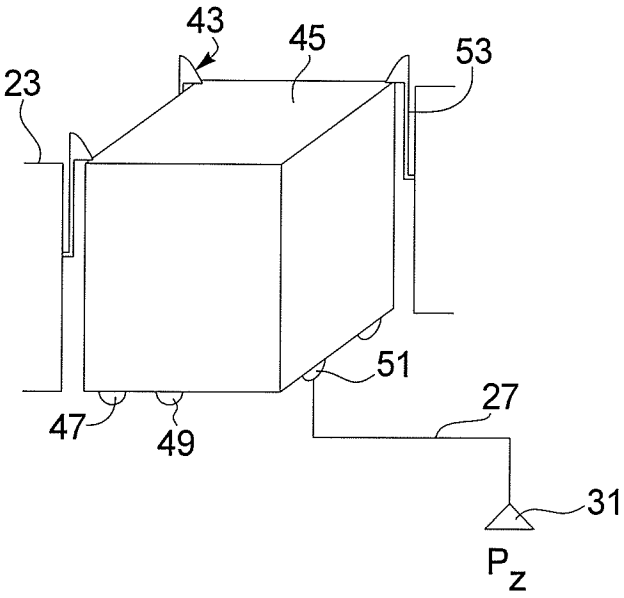
FIG. 2 shows a schematic perspective view of a modular pneumatic transducer occupying a modular slot.

Indicated schematically in part in FIG. 2 in a perspective illustration is one of the slots 23, which has a docking mechanism 43 on the slot side to realize the modularity, which is designed to securely yet releasably accommodate the electronic and/or pneumatic component 45, which is represented as a cube in FIG. 2, wherein in the accommodated position, an electrical contact between the electrical input 47 and the electrical output 49 of the electronic and/or pneumatic component 45 and the respective electrical output or input interface (33*a* to 33*d* or 35*a* to 35*d*) is established. The same applies for the pneumatic connection to the supply line 27 between the pneumatic connection 51 of the electronic and/or pneumatic component 45 and the electropneumatic input interface 25*a* to 25*d* of the slot 23*a* to 23*d*, which is not illustrated.

The docking mechanism 43 comprises a latching apparatus which is used to hold the electronic and/or pneumatic component 45 in the slot 23*a* to 23*d* against the respective slot side interfaces by means of bias or prestress. The latching apparatus can be released by means of manual actuation, so that the electronic and/or pneumatic component 45 are removed from the slot 23*a* to 23*d* and can be exchanged for another electronic and/or pneumatic component 45. The latching apparatus can be formed from a plurality of latching hooks 53 which are attached securely on the housing 17 in the region of the slot such that they can be actuated from outside.

The slots 23 and also the electronic and/or pneumatic components 45 inserted therein can be encapsulated in a fluid-tight manner to protect against external influences by means of a lid 19 (FIG. 1) which can be releasably fastened, particularly screwed, on the housing 17. When exchanging the modular electronic and/or pneumatic components 45, the lid 19 can be removed, so that the modular exchange process can be carried out.

Different occupation versions of the electropneumatic field device 7 according to the exemplary embodiment are illustrated in FIGS. 3 to 6, wherein the electropneumatic field device 7 can be connected to different electropneumatic external active elements outside of the field device housing 17.

Figure 3:
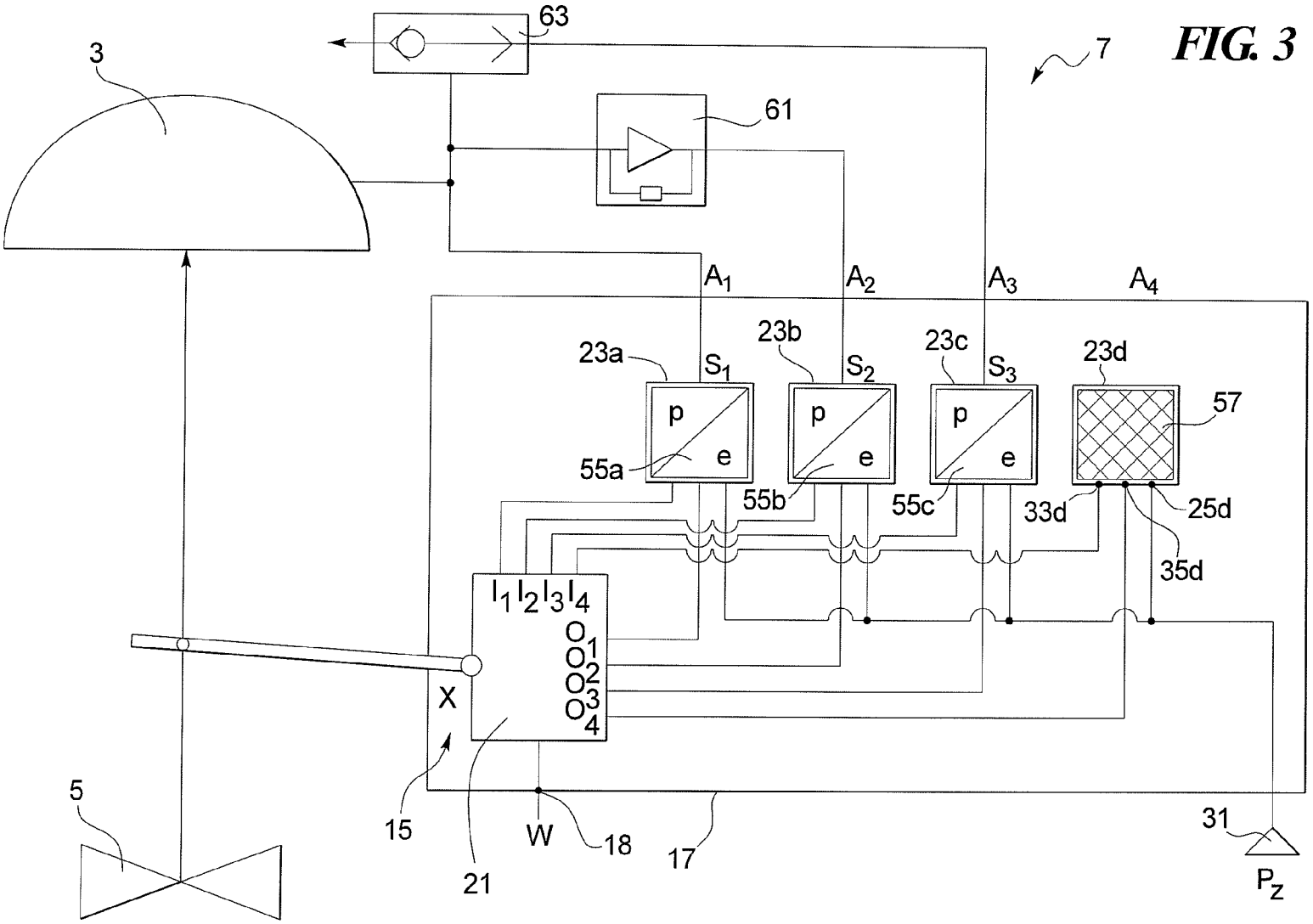
FIG. 3 shows a schematic illustration of a further preferred exemplary embodiment of an electropneumatic field device.

In FIG. 3, the field housing 7 is realized as a position controller. Of the four modular slots 23*a* to 23*d* which can be occupied, three are occupied with an electronic and/or pneumatic component, namely an I/P transducer 55*a*, 55*b*, 55*c*, wherein one of the modular slots 23*d* is occupied with an empty module 57. The empty module 57 and the modular slot 23*d* are adapted to one another in such a manner that the pneumatic input interface 25*d* is closed in an airtight manner and the electrical contacts 33*d*, 35*d* are covered such that they are protected from short circuit.

Via the electrical lines from and to the microprocessor 21, the latter determines whether a modular slot is occupied and with which electronic and/or pneumatic component. The microprocessor 21 also determines which model of I/P transducer 55*a* to 55*c* (for example with respect to the air power) is inserted into the respective slot 23*a* to *c*.

On the basis of the set-point control signal w, the microprocessor 21 transfers an electrical signal by means of its output $O_1$ to the I/P transducer 55*a* which forwards a pneumatic output signal $S_1$ directly to the pneumatic actuator 3 via the field output $A_1$. In accordance with the electrical signal via the output $O_2$, the I/P transducer 55*b* generates a second pneumatic output signal $S_2$, which makes it via the field output $A_2$ to a volume booster 61 which boosts the pneumatic output signal $S_2$ and forwards it via corresponding pneumatic lines to the actuator 3.

The I/P transducer arranged in the slot 23*c* generates a pneumatic output signal $S_3$ upon signalling by the microprocessor 21 via output $O_3$, which is supplied to a rapid ventilator or bleeder 63 via the field output $A_3$. The I/P transducer 55*c* controls the rapid bleeder 63 in such a manner that in the case of an in particular predetermined drop of the pneumatic output signal $S_3$, the rapid bleeder 63 effects a venting or airing of the pneumatic lines to the actuator 3, so that atmospheric pressure prevails at the actuator 3. Thus, the control valve 5 can achieve a safety position for example due to the spring forces acting in the actuator 3.

The microprocessor 21 can receive electrical signals via its inputs $I_{1-3}$, which for example can make statements about the output pressure $S_1$ to $S_3$. Alternatively, the microprocessor 21 can also receive information via the corresponding inputs $I_{1-3}$ about the type of electronic and/or pneumatic component which is used in the slot 23*a* to 23*c*. The microprocessor 21 can also detect whether an empty module 57 is inserted in the slot 57*d*.

Figure 4:
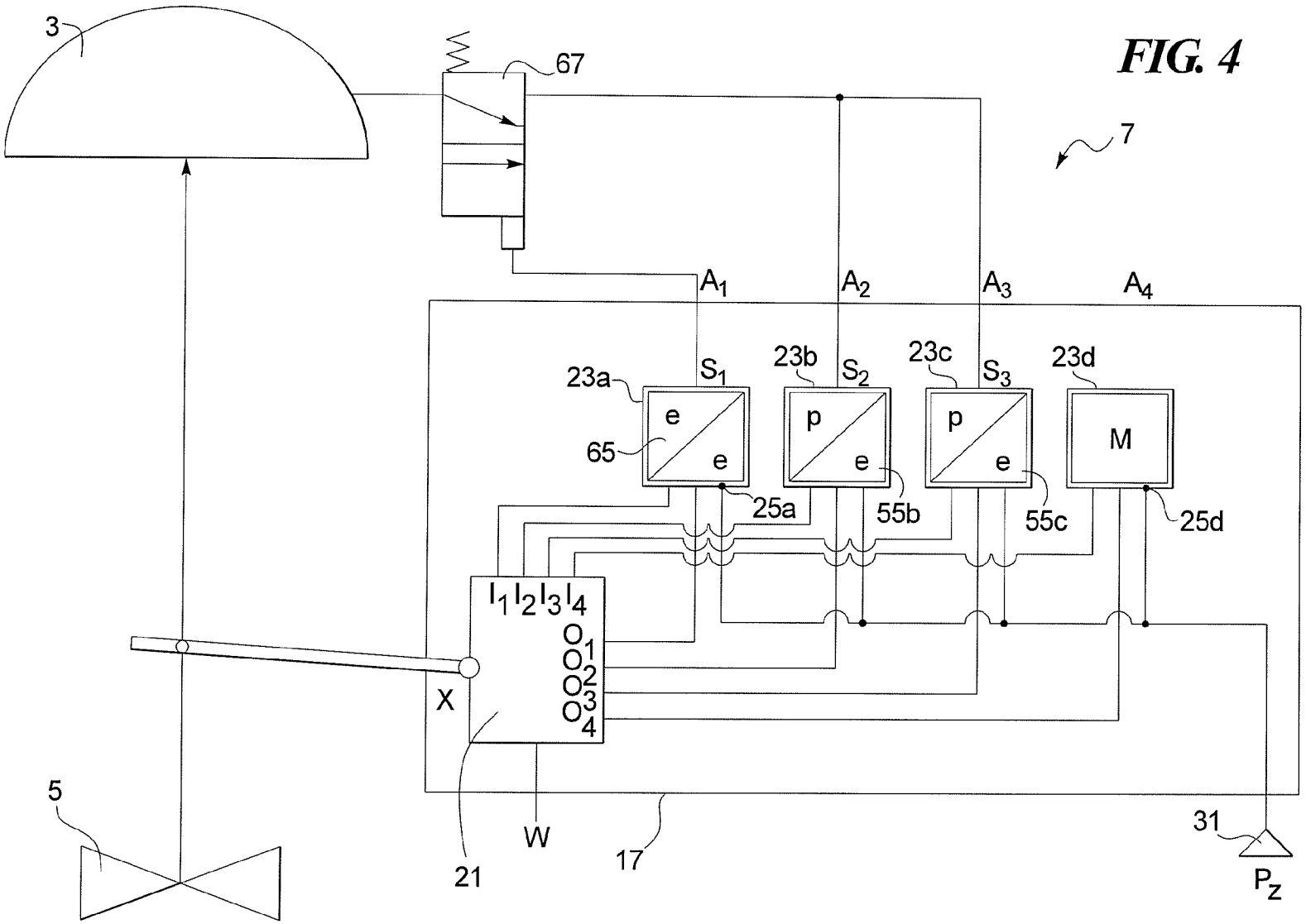
FIG. 4 shows a schematic illustration of a further preferred exemplary embodiment of an electropneumatic field device.

An alternative occupation of the field device 7 is illustrated in the embodiment according to FIG. 4. By means of the different occupation of the slots 23*a* to 23*d*, a different functionality is assigned to the field device 7.

An electrical output stage 65 (conversion of the electrical input signal into an electrical output signal according to a predetermined conversion routine) is inserted in the slot 23*a* of the field device 7 according to FIG. 4. The electrical signal received from the microprocessor via the output $O_1$ is converted to an electrical output signal $S_1$ and transmitted via the field output $A_1$ to an external solenoid valve 67 arranged outside of the field device housing 17. In this case, the output stage 65 is designed to close the pneumatic input interface 25*a* of the slot 23*a* in an airtight manner. Inserted in the second slot 23*b* is an I/P transducer 55*b*, which supplies a pneumatic output signal $S_2$ via the field output $A_2$ to the solenoid valve 67, which forwards the pneumatic output signal to the actuator 3. The I/P transducer 55*c* inserted in the modular slot 23*c* generates a further pneumatic output signal $S_3$, which is supplied like the pneumatic output signal $S_2$ to the actuator 3 via the external solenoid valve 67. The I/P transducer 55*c* can have the same pneumatic air power as the I/P transducer 55*b*. Alternatively, for an optimization of the position control, a smaller or a larger air power can be provided for the I/P transducer 55*c*. It is then the microprocessor 21 which selects which of the two I/P transducers 55*b* or 55*c* or even both should be responsible for the position of the control valve 5.

The fourth slot 23*d* is occupied with a modularly exchangeable electronic data memory M, which stores all electronic signals of the field device 7, particularly of the microprocessor 21 for a later readout. The digital signal transmission runs via electrical lines which are connected to the signal input $I_4$ and the signal output $O_4$ of the microprocessor 21. The data memory M is configured in such a manner with respect to the modular slot 23*d* that the pneumatic output interface 25*d* of the slot 23*d* is closed in an airtight manner.

Figure 5:
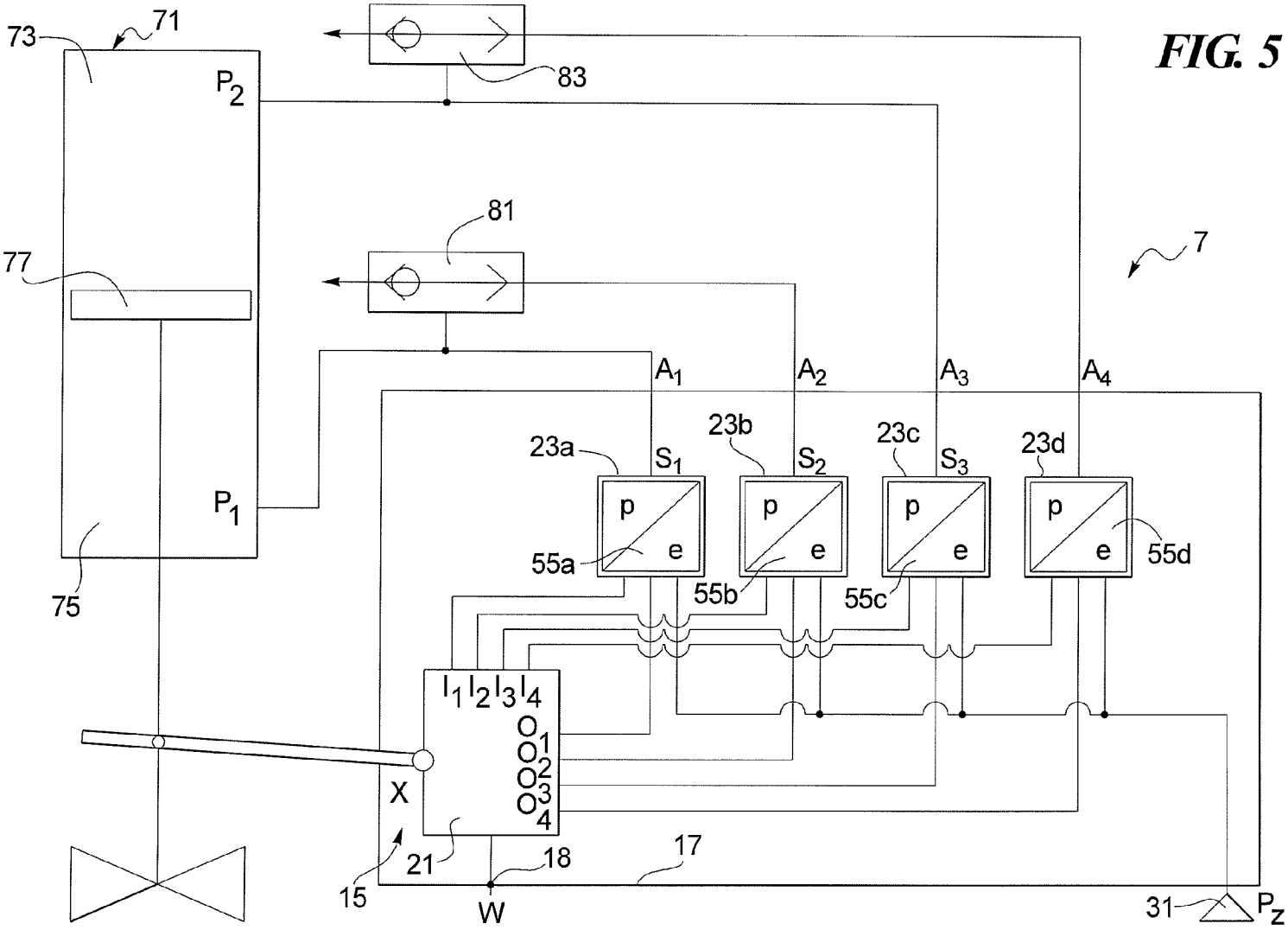
FIG. 5 shows a schematic illustration of an electropneumatic field device according to an exemplary embodiment, which is connected to a double-action pneumatic actuator.

Illustrated in FIG. 5 is a further application possibility of the electropneumatic field device 7 according to the exemplary embodiment, namely for pneumatic coupling to a double-action pneumatic actuator 71. The pneumatic double-action actuator 71 translationally actuates a control valve 5 and has two pneumatic working chambers 73, 75, which can be loaded with different pressures $P_1$, $P_2$ individually. The working chambers 73, 75 are pneumatically separated by a displaceable piston 77.

Both pneumatic working chambers 73, 75 are connected to a pair of electronic and/or pneumatic components in the slots 23*a, b* or 23*c, d*, respectively, which are in each case occupied with an I/P transducer 55*a* to *d*.

The pressure $P_1$ in the working chamber 75 is controlled by the I/P transducers 55*a*, 55*b*. The I/P transducer 55*a* generates a pneumatic output signal $S_1$, which is supplied via the field output $A_1$ directly to the working chamber 75 of the actuator 71. The I/P transducer 55*b* generates a second pneumatic output signal $S_2$, which is supplied via the field output $A_2$ to a rapid bleeder 81 and effects the airing of the pneumatic lines towards to the working chamber 75 of the actuator 3 in the event of a drop. In the event of airing, the pneumatic working chamber 75 is at atmospheric pressure.

The I/P transducer 55*c* in the slot 23*c* generates a third pneumatic output signal $S_3$, which establishes an essentially inverted signal course compared to the pneumatic output signal $S_1$ of the I/P transducer 55*a*. The pneumatic output signal $S_3$ is supplied directly from the field output $A_3$ to the actuator 71. The I/P transducer 55*d* generates a fourth pneumatic output signal $S_4$, which is supplied via the field output $A_4$ to a rapid bleeder 83 and controls the same in such a manner that when the pneumatic output signal $S_4$ drops, the rapid bleeder 83 effects the airing of the pneumatic connections towards the pneumatic working chamber 73 of the actuator 71. In this case also, the pneumatic working chamber 73 is then at atmospheric pressure.

The implementation of additional external rapid bleeders arranged outside of the field device housing 17 enables a much more precise and rapid pneumatic regulation of double-action actuators. While rapid bleeders 81, 83 have a hysteresis owing to their design, this overshooting can be prevented by means of the separate control by means of the I/P transducers 55*b* and 55*d*. In the case of airing, the pneumatic output signal $A_2$ and $A_4$ controlling the rapid bleeder 81, 83 can be reversed upstream of the pneumatic output signal $A_1$ and $A_3$ from venting to ventilating or aerating, so that the venting or aerating is braked without overshoots. The independence of the pneumatic output signals $A_{1\text{-}4}$ therefore offers a precise option for controlling pneumatic output values. In particular the combination of small air power with large air power can be carried out in a most accurate manner for realizing short control times.

Figure 6:
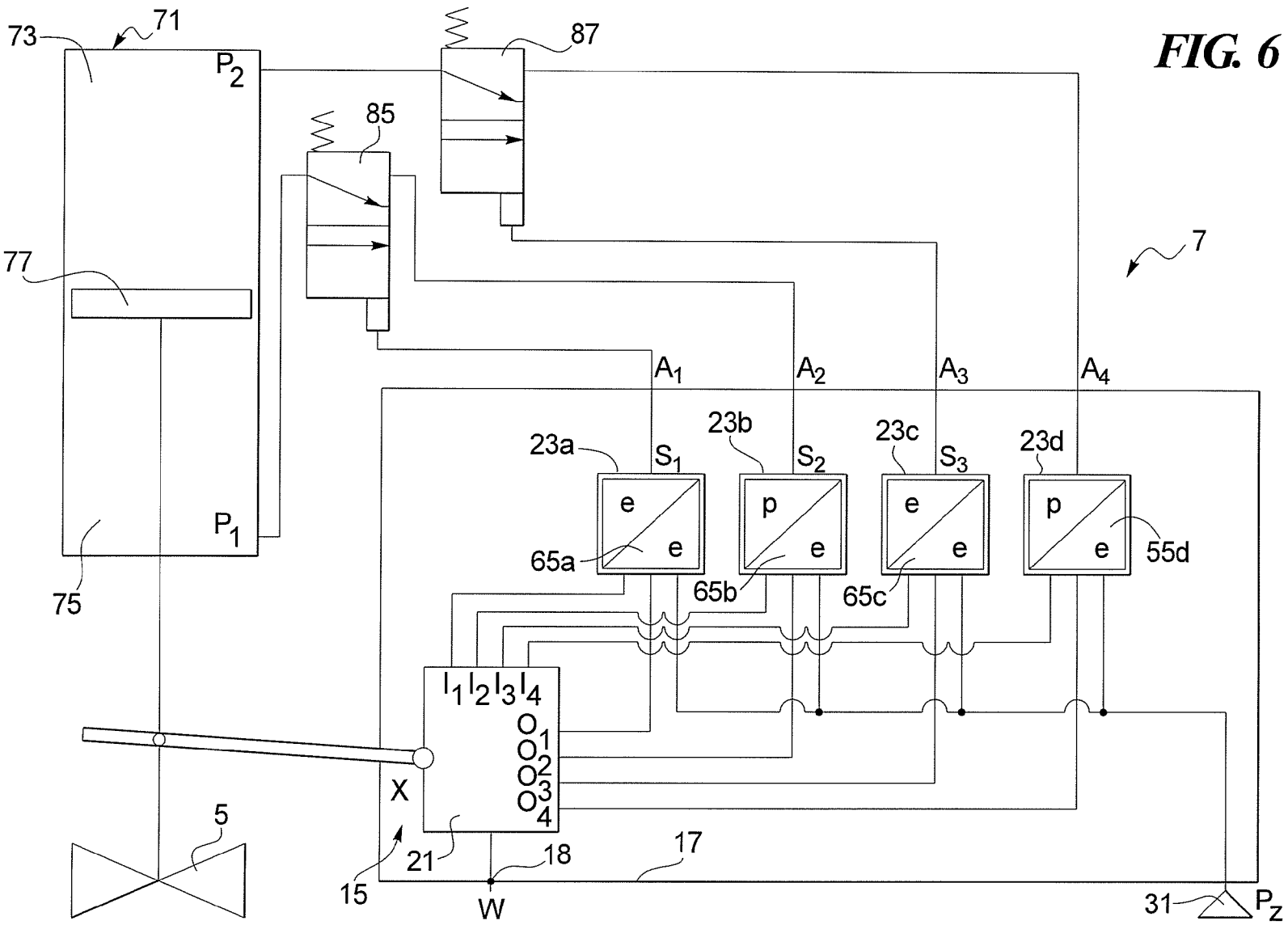
FIG. 6 shows a further preferred exemplary embodiment of an electropneumatic field device which is connected to a double-action pneumatic actuator.

Illustrated in FIG. 6 is an alternative occupation of the slots 23*a* to 23*d* and different external pneumatic active elements for a pneumatic double-action actuator 71. As in the embodiment according to FIG. 5, the slots 23*b* and 23*d* are occupied with an I/P transducer 55*b* or 55*d*.

The pneumatic transducers 55*b*, 55*d* are designed and controlled by the microprocessor 21 in such a manner that opposite output pressures $S_2$ and $S_4$ are realized. The pneumatic output signals $S_2$ and $S_4$ are supplied to external solenoid valves 85 and 87 respectively, which are positioned outside of the field device housing 17. Inserted in the slots 23*a* and 23*c* are electrical output stages 65*a* and 65*c* respectively, which function similarly to the embodiment according to FIG. 4. The electrical output stages 65*a* and 65*c* can connect the external solenoid valves 85 and 87 respectively independently of the pneumatic output signals $A_2$ and $A_4$.

Depending on which of the solenoid valves 85, 87 is connected, a different end position for the control valve 5 can therefore be achieved. It is additionally possible that to increase the control speed, depending on the desired direction of the valve movement, one of the two solenoid valves 87, 85 is connected or triggered for a short time and thus the respective working chamber 73, 77 is ventilated in order to accelerate the control movement in the direction of the ventilated chamber. In this case, delay times, which may be important for the position control, can be learned for example during commissioning according to an initialization procedure which is for example preprogrammed in the microprocessor, and these data can be used for a later position control.

The field device 7 as a position controller can be reconfigured according to an exemplary embodiment, in such a manner that the electropneumatic slot module, which previously operated in an inverted manner, is used as a second module in a simple-action position controller. In this case, the field device operates in the same direction of action as the first plug-in module pair for increasing the flow rate. Thus, a doubled air power results, which enables an increased control precision due to the decoupled control of the two plug-in module pairs.

It shall be clear that in the exemplary embodiments, a pneumatic current generator can also be inserted into one of the slots 23*a* to 23*d*. The current generator can be used to supply all electronic and/or pneumatic components of the field device 7 with electrical current.

The features disclosed in the above description and the figures can be of significance individually as well as in any combination for the realization of the various embodiments.

Although preferred exemplary embodiments are shown and described in detail in the drawings and in the preceding specification, they should be viewed as purely exemplary and not as limiting the invention. It is noted that only preferred exemplary embodiments are shown and described, and all variations and modifications that presently or in the future lie within the protective scope of the invention should be protected.

I claim as my invention:

1. An electropneumatic field device, comprising:

an electrical field input;

a pneumatic supply input;

at least one field output at which a field output signal is output based on a field control signal received via the electrical field input;

a group comprising at least two modular components of different functionality and at least one modular slot configured to be occupied with either of said modular components from said group, said at least two modular components of the group and the at least one slot being modularly adapted to one another such that interfaces of the slot and interfaces of either of said modular components in the slot merge into one another when the slot is occupied with either of said modular components so that the modular component which is in the slot is connected to said electrical field input and to said at least one field output; and an identification apparatus that is configured to detect if a type of modular component inserted in said at least one modular slot is a pneumatic component or an electrical output component, and if the modular component inserted in said at least one modular slot is the electrical output component, an interface of the at least one modular slot connected to the pneumatic supply input is blocked in an air tight manner.

2. The electropneumatic field device according to claim 1 wherein the at least one modular slot has a docking mechanism which comprises a positive-fit connection or traction-fit connection configured to releasably attach to the component of the group which is in the modular slot, and wherein the interfaces of the component in the slot and interfaces of the slot are pressed against one another.

3. The electropneumatic field device according to claim 1 wherein:

said at least one modular slot includes a plurality of modular slots, one of the plurality of modular slots is occupied by the electrical output component and another of the plurality of modular slots is occupied by the pneumatic component, the pneumatic component is connected to the pneumatic supply input, and when a slot of the plurality of said modular slots is not occupied, a pneumatic interface thereof is closed in an essentially airtight manner and is activated when the slot is occupied by the pneumatic component so that a pneumatic connection is provided to the pneumatic supply input.

4. The electropneumatic field device according to claim 1, wherein the identification apparatus comprises a microprocessor, and wherein the electropneumatic field device further comprises:

a plurality of said modular slots, each having an electrical interface connected via the microprocessor to the electrical field input, wherein at least one of the plurality of said modular slots has a pneumatic interface coupled to the pneumatic supply input, and the at least one field output is connected to a pneumatic component and outputs to a pneumatic actuator of a control valve.

5. The electropneumatic field device according to claim 1, further comprising:

a housing including a first fluid tight housing part and a second housing part accessible by a removable lid, wherein:

the identification apparatus is located within the first fluid tight housing part, the identification apparatus including a control electronics in the form of a microprocessor; and the at least one modular slot is located within the second housing part.

6. The electropneumatic field device according to claim 1 wherein the at least one modular slot has at least one of an electrical connection diagram and a pneumatic connection diagram.

7. The electropneumatic field device according to claim 1, further comprising at least two of said modular slots each having a respective modular component including an electropneumatic transducer received therein, wherein one of the electropneumatic transducers is connected by a respective field output to a pneumatic actuator of a control valve and the other electropneumatic transducer is connected by a respective field output to the pneumatic actuator through a pneumatic active element.

8. The electropneumatic field device according to claim h comprising:

at least two of said modular slots; and a pneumatic actuator with a control valve, a solenoid valve being connected to the pneumatic actuator, wherein one of the at least two slots being occupied with an electropneumatic transducer and the other of the at least two slots being occupied with an electrical output stage, and wherein a field output of the slot occupied with said electrical output stage connecting to an electrical input of said solenoid valve, and a field output of the slot having said electropneumatic transducer connecting to the pneumatic input of said solenoid valve.

9. The electropneumatic field device according to claim 1 wherein the identification apparatus comprises a microprocessor connected to said electrical field input, and wherein the electropneumatic field device comprises:

at least three of said slots, one of the at least three slots being occupied with an electronic data memory, another of said at least three slots being occupied with an electrical output stage, and another of said at least three slots being occupied with a pneumatic component.

10. The electropneumatic field device according to claim 1, further comprising a housing which is divided into a first housing part in which at least one electronic output stage component is arranged and a second housing part in which only a pneumatic component is arranged.

11. The electropneumatic field device of claim 1, further comprising:

at least four of said slots, and a double-action pneumatic actuator connected to a control valve, wherein the identification apparatus comprises a microprocessor connected to said electrical field input and being configured to receive position information from said control valve, and wherein first and second solenoid valves are connected to said double-action pneumatic actuator, a first of the at least four slots having an electrical output stage connected to an electrical input of the first solenoid valve, a second of the at least four slots having an electropneumatic transducer connected to a pneumatic input of the first solenoid valve, a third of the at least four slots having an electrical output stage connected to an electrical input of the second solenoid valve, and a fourth of the at least four slots having an electropneumatic transducer connecting to a pneumatic input of said second solenoid valve.

12. An electropneumatic field device, comprising:

a microprocessor connected to an electrical field input;

a pneumatic supply input;

at least two field outputs connected configured to control a pneumatic actuator of a control valve; and a group comprising at least two modular components, at least one of which is an electropneumatic component, and at least two modular slots configured to be occupied with a respective one of said modular components from said group, said at least two modular components of the group and the at least two slots being modularly adapted to one another such that interfaces of the slots and interfaces of the respective modular component in the slot merge into one another when the slot is occupied with the respective modular component so that when the respective modular component is in the respective slot, the respective slot is connected to said microprocessor, to said pneumatic supply input, and to the respective field output, and wherein, if the slot receives a modular component which is an electronic output stage and is not an electropneumatic component, then the pneumatic supply input to said slot is blocked.

* * * * *